United States Patent [19]

Ward

[11] Patent Number: 4,867,493

[45] Date of Patent: Sep. 19, 1989

[54] DOOR STOP

[75] Inventor: Alan S. Ward, Oulton Broad, England

[73] Assignee: Kickstop Limited, London, England

[21] Appl. No.: 849,521

[22] Filed: Apr. 8, 1986

[30] Foreign Application Priority Data

Apr. 9, 1985 [GB] United Kingdom ..... 8509014
Apr. 9, 1985 [GB] United Kingdom ..... 8509026
Apr. 9, 1985 [GB] United Kingdom ..... 8509027

[51] Int. Cl.[4] ..... E05C 3/04
[52] U.S. Cl. ..... 292/202; 292/DIG. 15
[58] Field of Search ..... 292/202, 216, 218, 57, 292/183, 193, DIG. 15, 304

[56] References Cited

U.S. PATENT DOCUMENTS

| | | | |
|---|---|---|---|
| 226,786 | 4/1880 | Pruden | 292/216 |
| 329,894 | 11/1885 | Evans | 292/216 |
| 912,295 | 2/1909 | DeVae | 292/202 |
| 976,509 | 11/1910 | Shepard | 292/202 |
| 977,225 | 11/1910 | Rogers | 292/DIG. 15 X |
| 1,037,439 | 9/1912 | Coffin . | |
| 1,144,576 | 6/1915 | Wilson | 292/202 |
| 1,313,069 | 8/1919 | Chason | 292/202 |
| 1,371,473 | 3/1921 | Crank | 292/216 |
| 1,473,926 | 11/1923 | Emslie . | |
| 1,650,005 | 6/1875 | Knorp | 292/202 |
| 1,770,751 | 7/1930 | Hall | 292/57 |
| 1,791,387 | 2/1931 | Stargardt . | |
| 1,810,856 | 6/1931 | Schnell | 292/202 |
| 1,895,146 | 1/1933 | Brown | 292/DIG. 15 X |
| 1,925,244 | 9/1933 | Goodrich | 292/338 X |
| 1,985,164 | 12/1934 | Green | 292/338 |
| 2,041,430 | 5/1936 | Plym | 292/202 X |
| 4,126,342 | 11/1978 | Harley | 292/269 |
| 4,348,879 | 9/1982 | Knierim | 292/DIG. 15 |

FOREIGN PATENT DOCUMENTS

| | | |
|---|---|---|
| 278990 | 8/1913 | Fed. Rep. of Germany . |
| 18440 | 8/1913 | United Kingdom . |

*Primary Examiner*—Richard E. Moore
*Attorney, Agent, or Firm*—Wenderoth, Lind & Ponack

[57] ABSTRACT

A mechanism for restricting the extent to which a closure member for an access aperture into a structure can be moved from a fully closed position to an open position via a predetermined partially open position at which further opening of the closure member can be impeded by the mechanism. The mechanism is adapted to be mounted internally of the structure and adjacent the head and/or foot of the aperture. The mechanism includes a stop member adapted to be mounted on or to engage with the head and/or foot of the closure member and a guide member adapted to co-operate with the said stop member guiding the travel of the stop member between an operative position at which the mechanism acts to impede further opening of the closure member beyond the predetermined partially open position and an inoperative position in which the mechanism does not impede the opening or closing of the closure member, such travel passing through an intermediate position at which the closure member must be substantially in the fully closed position to permit the passage of the stop member to enable it to travel from its operative position to its inoperative position. The guide member is adapted to be mounted adjacent the aperture so that at least that part thereof co-operating with the stop member is located below the lower or above the upper extremity of the closure member.

10 Claims, 4 Drawing Sheets

DOOR STOP

BACKGROUND OF THE INVENTION

The present invention relates to a door stop, notably to one which provides improved security to the user.

Door stops have been proposed in which a chain or pivotted bar is attached to the door frame and to an anchorage point on the door so as to limit the extent to which the door can be opened This allows a user to inspect a caller without having to open the door fully and to retain some security at the door whilst doing so However, such chains or bars are exposed through the gap between the partially open door and the frame to someone standing outside the door and can therefore be cut from outside Also, an intruder can insert his foot into the gap betweeen the door frame and the partially opened door to prevent the door from being closed whilst he cuts the chain or bar. Since the chain or bar provides the only physical link between the door and the frame to prevent the door opening, severance of the bar or chain removes all restraint on the door.

BRIEF SUMMARY OF THE INVENTION

I have now devised a form of door stop mechanism to be mounted at the head and/or foot of a door or other opening which co-operates with a guide member so that it travels through a path which requires that the door, window or other closure be substantially closed before it can be disengaged from the door, thus giving greater security to the user. Furthermore, the stop member providing the physical barrier to further opening of the door is located within or behind the door and is not accessible to an intruder from outside and usually only part of the guide member is exposed to an intruder. If the intruder attempts to break that part of the mechanism, the physical barrier to further opening of the door remains and the intruder can not gain access through the doorway.

Accordingly, the present invention provides a mechanism for restricting the extent to which a closure member for an access aperture into a structure can be moved from a fully closed position to an open position via pre-determined partially open position at which further opening of the closure member can be impeded by the said mechanism, the mechanism being adapted to be mounted internally of the structure and adjacent the head and/or foot of said aperture, said mechanism comprising:

- a stop member adapted to be mounted on or to engage with the head and/or foot of the closure member and;
- a guide member adapted to co-operate with the said stop member which guide member is adapted to guide the travel of the stop member between an operative position at which the mechanism acts to impede further opening of the closure member beyond the said pre-determined partially open position and an inoperative position in which the mechanism does not impede the opening or closing of the closure member, said travel passing through an intermediate position at which the closure member must be substantially in the fully closed position to permit the passage of the stop member to enable it to travel from its operative position to its inoperative position; the said guide member being adapted to be mounted adjacent said aperture so that at least that part thereof co-operating with the said stop member is located below the lower or above the upper extremity of said closure member. Preferably, the guide means extends at least in part below the closure member during its movement from the fully closed position to the said partially open position whereby the closure member obstructs access to the guide member when the closure member is in the partially open position. It is further preferred that the guide member causes the stop member to follow a line of travel which intersects the path of the travel of the leading edge of the inner face of the closure member at a point closely adjacent the frame into which the closure member locates so that the closure member must be substantially closed before the stop member can be moved out of the path of the closure member and/or the stop member can be disengaged from the guide member.

It has been proposed to provide a stop member at the foot of a door frame which is carried by a pivotting arm so that it can be swung from an inoperative position beyond the arc of the swing of the door to a position at which the stop lies in the path of the door and hence prevents opening of the door beyond the limit of swing of the stop. However, the arm pivots about a point under the door in the closed position. Such a construction can readily be rendered inoperative because the stop can be disengaged from the door by an intruder when the door is partially open. I have found that this is due to the fact that the arc of the line of travel of the stop carries the stop clear of the edge of the door well before the door closes. In the mechanism of the invention, the line of travel followed by the stop member passes through a point closely adjacent the door frame before the stop member is disengaged or passes outside the arc of swing of the door and hence the stop member can only be released from the door o from its guide member when the door is substantially closed.

The present invention can be applied to a wide range of types of closure members, for example windows or the like in cars, boats or caravans, as well at to doors in buildings and other structures. For convenience, the invention will be described hereinafter in terms of a door stop for a door in a dwelling and the term door is to be construed as including other types of closure members in general wherever the context permits. Furthermore, the mechanism of the invention can be mounted at the head and/or the foot of the door, the door frame or the structure surrounding the door frame or door opening. For convenience the term floor will be used herein to denote the floor itself or any part of the surrounds to the door opening, including the frame to the door opening whether below or above the extremities of the door itself.

The guide means can take a number of forms, notably a track into which the stop member or a member carrying the stop member engages and which guides the stop member along the desired line of travel. Alternatively, the guide member can be a member which carries the stop member and itself rotates or otherwise moves to carry the stop member along the desired line of travel.

Thus, from a further aspect, the present invention provides a mechanism for restricting the extent to which a door or other closure member can open, which mechanism is adapted to be mounted adjacent the head and/or foot of the opening served by the closure member, which mechanism comprises: a stop member adapted to be mounted on or to engage with the closure member; and a second member adapted to be mounted on the floor adjacent the opening edge of the closure member and having a track therein adapted to receive the stop member or a member associated therewith and to guide and restrict the travel of said stop member between two extremities of travel, the line of travel of the stop member between one extremity and the other passing adjacent to the fully closed position of the closure member, whereby the closure member must be substantially closed before the stop member can release the closure member.

Preferably, at least part of the second member is adapted to be mounted into the floor adjacent or in the path of swing of the closure member so that access to the mechanism is made more difficult.

BRIEF DESCRIPTION OF THE DRAWINGS

For convenience the invention will be described hereinafter with respect to the accompanying drawings in which.

Figure 1:
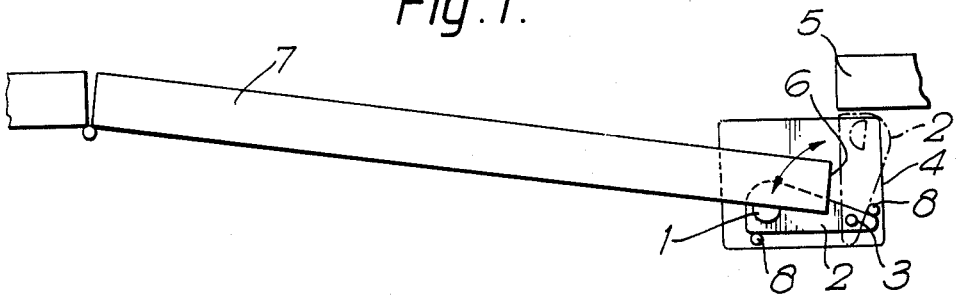
FIG. 1 is a diagrammatic plan view of a door stop of the invention mounted adjacent the opening edge of a conventional hinged door.

With the device shown in FIG. 1 there is an upstanding stop member 1 which is adapted to be placed in the path of the door and to restrict the extent of opening of the door. The stop can for example be an upright rod, block or other member having a rounded, triangular, uniform, tapered or other cross section or can be the flange of an L shaped member. If desired, the stop can be provided with a rubber or similar sleeve or coating to cushion the contact with the door surface and reduce the risk of damage to the door. Furthermore, the contacting face of the stop can be profiled so as to seat flat against the inner face of the door.

The stop 1 is mounted substantially vertically upon an arm 2 which is preferably substantially horizontal and pivots about a pin 3 or other pivot mounted on a generally horizontal base plate 4. Alternatively, pivot 3 can be mounted directly into the floor. The pivot pin 3 is preferably mounted outside the arc of travel of the leading edge of the door so that the arc of swing of the arm intersects the arc of swing of the leading edge of the door close to the door frame and passes close to the interior face of the door in the closed position, with arm 2 passing under the foot of the door. However, it is within the scope of the present invention for the pivot 3 to be located within the arc of travel of the door and for the stop member to act on any point on the door intermediate the hinges and the leading edge of the door.

Arm 2 carries stop 1 from an in-operative position outside the arc of the swing of the door, as shown dotted in FIG. 1, along a path which carries the stop closely adjacent the door frame 5 at the leading edge 6 of the door 7 to its operative position within the arc of swing of the door. Where the pivot 3 is located within the arc of swing of the door, the arc of travel of the arm 2 can be in the opposite sense to that shown in FIG. 1.

By requiring that the line of travel of the stop pass close to the interior face of the closed door, it is necessary that the door be substantially closed before the stop can pass to its inoperative position to release the door for full opening.

Preferably, the arm 2 has a significant plan area which will lie under the foot of the door when the stop engages with the partially open door, since this will reduce the risk of the stop being twisted off its pivot or out of its floor mounting by an intruder pushing on the door. Thus, the arm 2 can be formed with an L section, the upright of the L acting as the stop member and the lower limb of the L underlying the door.

The desired swing of the arm 2 can be achieved by providing limiting members against which the arm 2 bears at the limits of its travel. The limiting member can take the form of a second stop member 8 mounted on the floor or on plate 4 at the desired point. Alternatively, the second stop can act against a rearward extension to arm 2 so that the second stop 8 does not lie in the path of swing of the door or cause obstruction to a user of the door.

Figure 2:
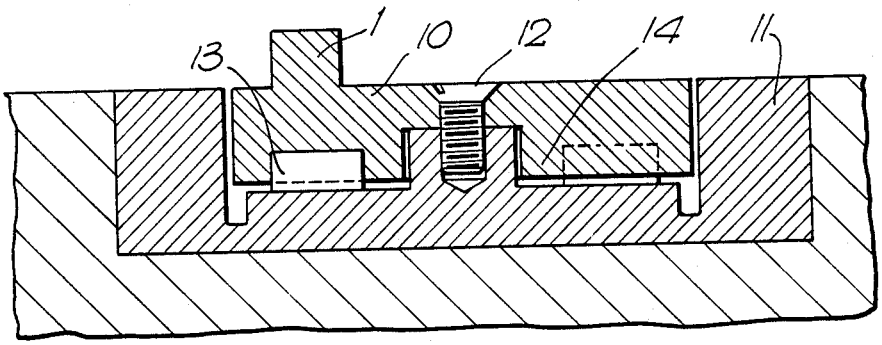
FIG. 2 is a section elevation view of a particularly preferred form of the type of door stop shown in FIG. 1.

A particularly preferred form of this type of door stop is shown in FIG. 2. In this, the stop 1 is mounted on the upper face of a disc 10 rotatable about a substantially vertical axis on a base plate 11 set into the floor adjacent the leading edge of the door. The disc 10 is held in place by a screw 12 or other means and the lower face of the disc 10 or the upper face of the base plate 11 can carry rollers or the like to provide rolling support for the plate 10 as it rotates.

The lower face of the disc 10 and the upper face of the base plate 11 carry co-engaging ribs 13 and 14 or other protrusions so that the disc can only rotate between given extremities of travel. The base plate 11 can be formed to encase the sides of the disc so as to provide a totally enclosed unit which ca be sunk into the floor to leave the stop 1 upstanding sufficiently to engage the door.

In operation, the disc is rotated to carry the stop into the path of the door, the abutment of ribs 13 and 14 then limiting the extent of rotation of the disc and hence fixing the point at which the stop 1 halts the door. To release the door, it is necessary to close the door and to rotate the disc to carry the stop clear of the path of the door.

By having a totally enclosed unit which is sunk into and flush with the floor, access to the mechanism is virtually impossible for an intruder from outside the doorway or by a vandal when the door is open. Furthermore, the disc can be mounted so that it is substantially flush with the floor and can carry a decorative top panel, e.g. of carpet or the like to match its surrounds, minimising the intrusion of the device on the decor of the room in which it is used. Accidental rotation of the disc when it is not in use can be prevented by a suitable locking pin or the like.

The invention thus provides a door stop mechanism which comprises a support member carrying a stop member adapted to engage a door to impede movement thereof, the support member being rotatably mounted upon a base member whereby the arc of travel of that part of the support member carrying the stop member is adapted to pass below the arc of travel of the door, said base member being provided with one or more limiting members to limit the arc of travel of the support member, the arc of travel of the stop member being adapted to pass immediately adjacent the face of the door when in the closed position.

Figure 3:
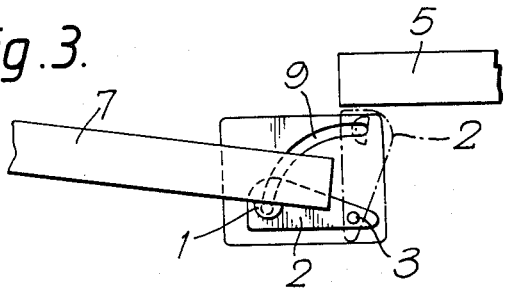
FIGS. 3 and 4 are a plan view and a sectional elevation view of a slightly modified embodiments, respectively, of the door stop according to the invention.
Figure 4:
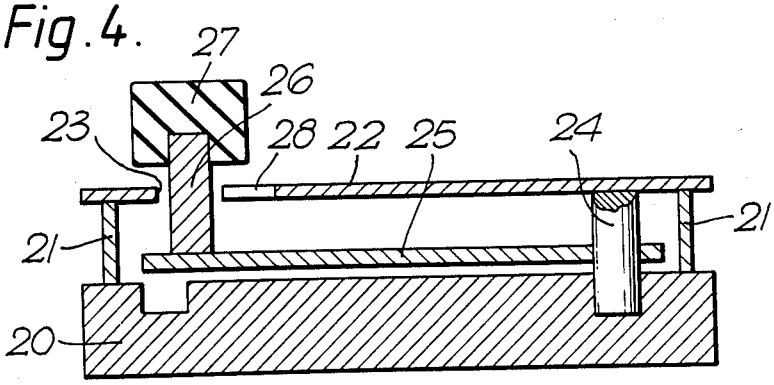

Instead of limiting the arc of travel of the arm 2 by means of the secondary stops the travel of the stop member can be limited by engagement of part of the stop member 1 or part of the arm 2 in a track, as shown in FIGS. 3 and 4. The ends of track define the extent of travel of the stop and hence the extent to which the door can be opened. Thus, the stop member 1 can extend below the level of the arm 2 to form a pin or other projection which engages in an arcuate groove or aperture forming the track 9 set into the floor or otherwise mounted fixedly below the path of the stop member 1. It is particularly preferred to form the track as a groove or aperture in base plate 4 upon which the arm and stop member are mounted so as to provide a unitary construction, at least part of the base plate underlying the foot of the door.

The above simple form of the door stop of the invention can be modified in a number of ways. Thus, as shown in FIG. 4, it is particularly preferred to mount the arm 2 below the top plate of an assembly which is set into the floor with the stop member projecting through a track in the top plate. In this way the door stop mechanism can be formed as an enclosed unit which can be set into the floor with only the stop member exposed.

Thus, from a particularly preferred aspect, the invention provides a door stop mechanism as defined above in which the limiting members are provided by a member having an elongated aperture or recess therein defining a path whose extent is limited by the extremities of the aperture or recess, the stop member or the support member engaging with the aperture or recess and adapted to engage with either extremity of the aperture or recess at either end of the travel of the stop member. Preferably, the aperture or recess defines an arcuate path and the stop member is mounted on a pivotally mounted arm so that the stop member travels along the arcuate path.

This preferred form of the door stop is best shown in FIG. 4 and comprises a base plate 20 of a generally square plan shape. The base plate carries upstanding side walls 21 to form an open topped box-like construction. Preferably, the walls 21 are inset from the edge of the base plate to provide a peripheral rim, which can be used to key the device into the concrete of a floor or to mount other items on. The top of the box-like construction is closed by a lid 22 which has an arcuate channel 23 cut therethrough and can extend to provide a rim by which the device is screwed or otherwise mounted onto the floor.

Within the box-like construction is a pivot pin 24 or the like substantially normal to the plane of the base plate 20. Pivotally mounted on the pin 24 is an arm 25 adapted to swing through an arc substantially concentric with the arc of the arcuate channel 23 and substantially co-planar with the base plate 20. At its free end, the arm 25 carries an upstanding member 26 which extends through the channel 23. The arm 25 and the member 26 are conveniently formed from a strip or bar of metal or similar rigid material so that member 26 can act as the face which bears against the door when in use. If desired, member 26 can carry a rubber sleeve or knob 27 mounted thereon.

With the devices shown in FIGS. 2 and 4, the arm and pivot are mounted in the box-like construction and this latter can be sunk into the floor under the arc of swing of the door thus further protecting the mechanism against damage by an intruder.

The above forms of device can be altered to suit particular circumstances, e.g. the length of the arms 2 or 25 can be adjustable to suit different sizes of door, or the pivot point of the arms can be moved to enable the device to pivot about different arcs.

If desired, the devices described above can be provided with intermediate stopping points in their line of travel so that the stop member bears against the door when the latter is in the closed position, and thus acts as a lock for the door. For example, the arm 25 of the device of FIG. 4 can be spring loaded against the inner radius of the arcuate channel 23 which has a recess 28 cut into its radially inner wall at the desired position. Arm 25 can thus drop member 26 into the recess 28 and thus locate the stop member 26 in the desired position in the course of its travel. Alternatively, the radially outward face of the stop member can carry a ball, roller, magnet or other catch to engage with co-operating recess in an arcuate faced member mounted on the door and/or the door frame.

Where an enclosed unit is provided, as in FIGS. 2 and 3, it is preferred to provide some means for inhibitting the entry of solid particles into the area of the moving parts of the device. Thus, the lips of the tracks and channels can be provided with rubber lips or Nylon brushes or the like to at least partially seal the opening against ingress of particles. It is also preferred to provide means for removing any particles which may enter the device. This is conveniently done by allowing the underside of the arm supporting the stop member to sweep particles into a recess at either end of its travel. Alternatively, the stop and its arm or disc support can be formed as a removeable unit which is removed to permit removal of particles from the base member housing the moving parts.

Figure 5:
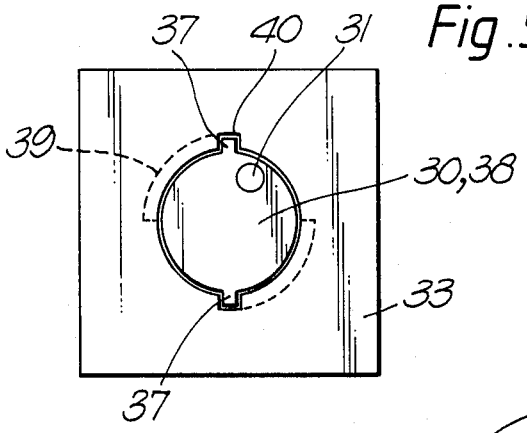
FIG. 5 is a plan view of a further modified embodiment of the door stop according to the invention.

An example of such a construction is shown in FIG. 5. The disc 30 of the device of FIG. 2 is modified by the provision of one or more radially extending locking lugs or arms 37 and is rotatably mounted on a secondary base member 38 to provide a complete rotating unit which seats into a substantially circular well in the base member 33. Member 33 is modified by the provision of a circumferential groove or grooves 39 into which the lugs 37 engage when the rotating unit is located in the base member. Grooves 39 extend only partially around the internal circumference of the substantially circular well and the ends of the grooves serve as the stops to limit the extent of rotation of the disc 30. At that end of groove 39 corresponding to the inoperative position of the disc is an entry port 40 extending to the upper face of member 33 to permit lugs 37 to drop into the start of the grooves 39. The disc 30 can thus be rotated to bring the lugs 37 and the entry ports 40 into register to permit the disc 30 to be inserted into member 33. Rotation of the disc 30 when in position carries the lugs out of register with the entry ports and thus locks the disc into the member 33.

The device of FIG. 4 can be modified in a similar manner to permit the arm 25 to be removed through a slot in the upper member 22 when in the inoperative position.

Figure 6:
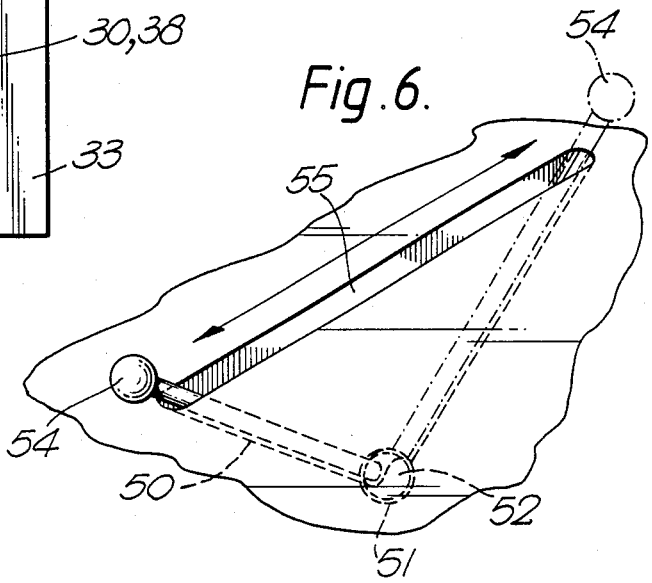
FIGS. 6 and 7 are diagrammatic views of modified forms of the path which the upper end of the dumbell of the door stop according to the invention can travel.
Figure 7:
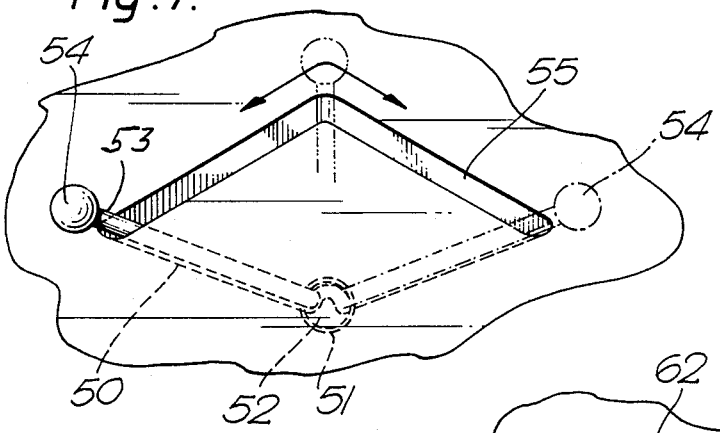

Instead of having a stop member which travels an arcuate path between its operative and non-operative positions, the stop can follow a linear or other path. Thus, as shown in FIGS. 6 and 7, the door stop assembly can take the form of a groove 50 in the floor which converges downwardly to a socket 51 at the base thereof. Within the socket 51 is located the end 52 of a dumbell shaped member 53, the upper end 54 of which protrudes above floor level to provide a ball shaped door stop member. The plan shape of the mouth 55 of the groove 50 dictates the path which the upper end 54 of the dumbell follows. This can be a linear path as shown in FIG. 6 or can be a dog-leg or other path as shown in FIG. 7.

The door stop mechanisms described above are typically operated by knocking the stop member into the path of the door before the door catch is released. This is conveniently done by merely kicking the exposed stop member and does not require the manual dexterity that a security chain does. However, in some designs the stop can be started on its travel, as with the rotating disc or arm designs shown in FIGS. 2 and 4, and the opening of the door deploys the stop fully to its operative position. Alternatively, the stop can be spring biassed into the operative position and is released by a foot stud to enable the elderly or infirm to operate the stop assembly rapidly and simply.

As indicated above, the stop member can be carried by the door itself rather that by a separate guide member. In this case the stop member releasably engages with a fixed guide member at a point closely adjacent the door frame so that the door is substantially closed before the stop member can be released from the fixed guide member to allow the door to be opened.

The fixed guide member can take the form of a track in a member mounted at the foot and/or head of the door opening into which a bolt or other stop member carried by the door engages. It is preferred that the stop member take the form of a conventional type of bolt assembly with the barrel of the bolt being reciprocated to bring the free end thereof into and out of engagement with track. The bolt assembly can be mounted at the head or foot of the door, preferably on the interior face of the door, and at any suitable point between the hinges and leading edge of the door. Preferably, the bolt assembly is mounted adjacent the leading edge of the door so that the bolt mechanism can be operated in conjunction with the door catch or lock. The bolt mechanism can be a single barrel bolt or it can be a double acting type which extends bolt barrels both upwardly and downwardly, as with an espagnol type of door catch, to engage tracks both in the floor and above the door opening.

The track can be formed as a cut-out in the floor itself. However, it is preferred to form the track as a metal fitment which is set into the floor, eg. as a plate with a groove or aperture therein into which the bolt is lowered. Typically, the track will comprise a channel piece set into the floor with a cap member having an elongated aperture therein into which the foot of the bolt is to engage. As indicated below, the track can be an arcuate track for use with a swinging door, or can be a substantially linear track for use with a sliding door. The track is located on the interior of the door, or underlies it, so that an intruder does not have access to it.

The track and/or the bolt incorporate means by which the foot of the bolt is held in the track except at the closed position of the door, when the bolt can be withdrawn from the track to release the door. This means can be an expanding section to the foot of the bolt which is expanded as the bolt seats home in the track. Alternatively, the shank of the bolt can carry a rectangular, oval or other shaped foot which has a dimension greater than the aperture of the track. This can be rotated so that the larger dimension aligns with the longitudinal axis of the track to permit the foot to be inserted into the track. Further rotation of the bolt causes the foot to be retained under the lips of the aperture. Alternatively, the entry to the track can have an enlarged aperture to permit entry of the foot of the bolt without the need for rotation. The lips of the aperture can be provided by an integral flange or by the use of a cap having an appropriate aperture cut therein.

An especially preferred form of such a construction is shown in FIGS. 8 to 11 and comprises a bolt-like member 60 journalled as a sliding fit in a mounting 61 on the interior face of a conventional hinged door 62, preferably adjacent the leading edge of the door. Preferably, the barrel carries a radial arm 63 which can be moved manually or by means of a user's foot to move the bolt barrel downwardly into engagement with a channel in the floor. If desired, the barrel or the arm can be extended upwardly so that it can be operated without the need to stoop to near floor level. Also, to aid operation by an elderly or infirm person, the bolt mechanism can be spring loaded to drive the foot of the bolt into the channel when it is in register with the bolt entry point.

Figure 10:
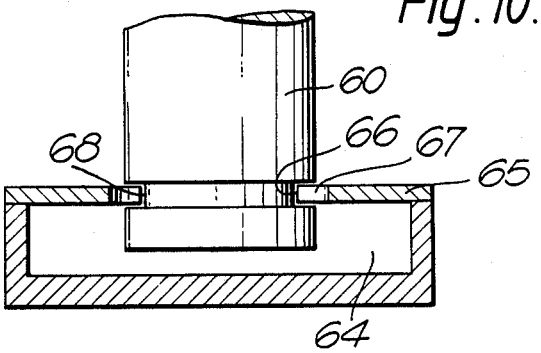
FIG. 10 is a sectional view of the door stop as shown in FIG. 9.

The foot of the bolt 60 is to be lowered into a channel 64 in the floor under or adjacent the leading edge of door 62. The channel 64 is typically formed as a generally U shaped member set into the floor, or as a groove or track cut into the floor itself or in a plate fixedly mounted thereon. Referring to FIG. 10, the open top of the channel is provided with a cap member 65 which forms or is provided with an elongated aperture 66 following the line of travel of the bolt foot. This aperture serves to guide and retain the bolt foot within the channel.

The foot of the bolt can only be disengaged from the channel when the door is substantially closed. This is conveniently achieved, as shown in FIG. 10, by having the foot of the bolt 60 formed with a section of larger diameter than the aperture 66 to the open top of the channel. The aperture 66 has a wider section 67 at that end immediately adjacent the closed position of the door to provide an entry port for the foot of the bolt. The foot of the bolt is cut with a circumferential groove 68 which engages with the lip of the aperture in the cap to the channel and thereby locks the foot of the bolt in the channel once the door carries the bolt away from the entry port.

Figure 11:
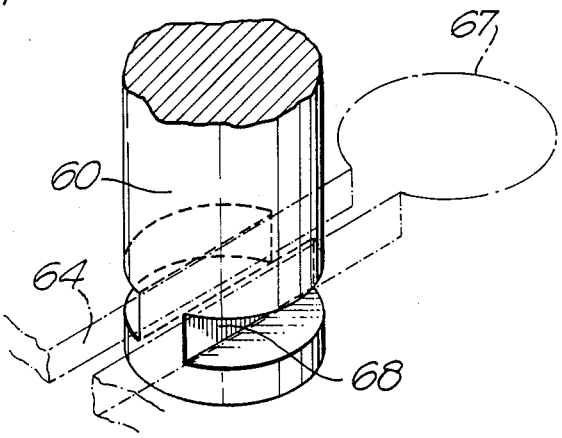
FIG. 11 is a perspective view of a part of the door stop is shown in FIG. 9.

The groove in the foot of the bolt need not extend fully circumferentially, but can be located along two substantially parallel chords on either side of the bolt, as shown in FIG. 11. The barrel of the bolt can be rotated through 90° when in the wider entry port section 67 of the aperture 66 to bring the grooves out of register with the lips of the cap 65 and thus prevent movement of the foot of the bolt along the the channel 64. The bolt thus also acts as a dead lock when in this position.

As with the other forms of door stop described above, it is desirable to provide some means for inhibitting the entry of dust and grit into the channel 64. For example, the aperture can be provided with rubber lips or Nylon brushes or the like and sumps can be provided at either end of the channel 64 into which the foot of bolt 60 sweeps any particles as it moves within the channel. It is also preferred to form the cap 65 as a removeable member to enable the mechanism to be dismantled for service and repair.

Figure 8:
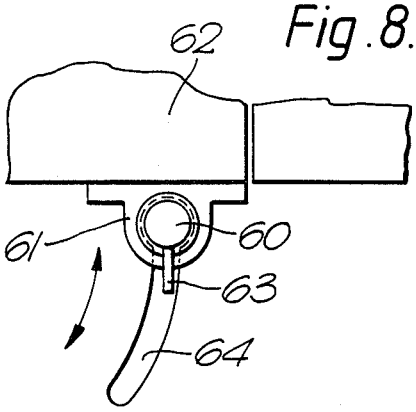
FIG. 8 is a plan view of a further modified form of the door stop according to the present invention.
Figure 9:
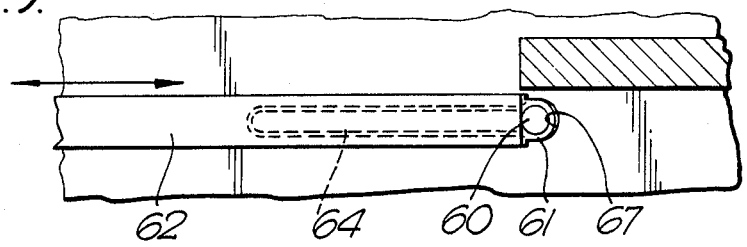
FIG. 9 is a plan view of a still further modified embodiment of the door stop according to the invention.

The forms of the mechanism of the invention shown in FIGS. 9 to 11 are of especial use with patio and other doors which travel linearly from a closed to an open position rather than swinging through an arc as shown in FIG. 8. In such cases, the channel 64 follows a substantially linear path either to one side or substantially co-incident with the line of travel of the door, as shown in FIG. 9. When used with such doors, the channel can be located adjacent either end of the door. When the channel is located in the line of travel of the door at the inner end of the door, opening of the door will carry the door over the channel and protect it yet further from an intruder.

Figure 12:
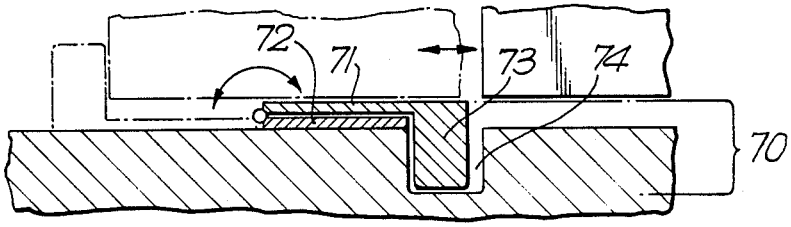
FIG. 12 is a sectional elevation view of a further modified form of a door stop according to the invention.

In many of the above forms of the door stop mechanism of the invention, the stop member has been deployed by pivotting it in the horizontal plane about a generally vertical axis. However, it is within the scope of the present invention for the stop to be deployed by pivotting it about a generally horizontal axis. Thus, as shown in FIG. 12, a stop member is extended from a position at which it lies under the path of the door to a raised position at which it lies in the path of the door. Such a mechanism comprises an L shaped stop member 70 pivottally attached across the free end of one of the limbs 71 of the L to a mounting plate 72 fixed to the floor in the path of the swing of the door. In its inoperative position, the member 70 lies in a position in which the stop limb 73 of the L is located into a corresponding recess 74 in the floor where it is directed generally downwards and clear of the underside of the door. To adopt its operative position, the member 70 is pivotted upwardly to carry the stop 73 through substantially 180° so that the stop 73 adopts an upstanding position to bear against the door as shown in FIG. 12.

Figure 13:
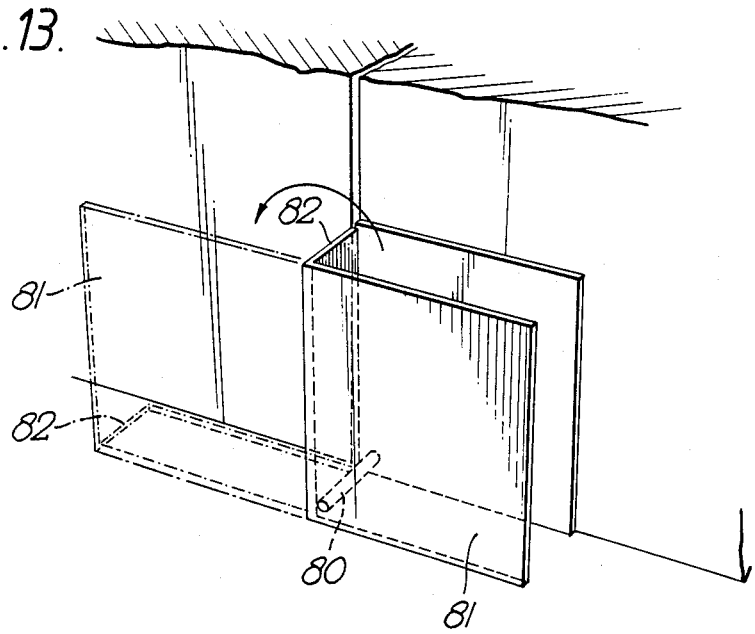
FIG. 13 is perspective view of a still further modified form of the door stop according to the invention.
Figure 14:
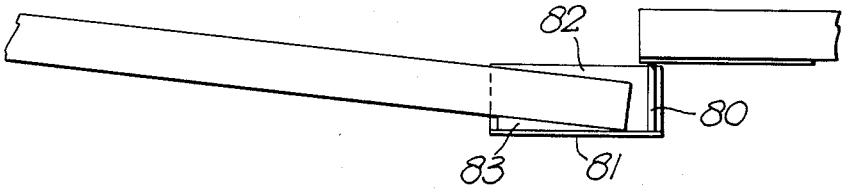
FIG. 14 is a plan view of the door stop of FIG. 13 showing it in an operative position.

A further form of such a mechanism is shown in FIGS. 13 and 14. The arm carrying the stop member is mounted on a substantially horizontal pivot 80 protruding from the foot of the door frame or from the adjacent wall. The arm pivots down along a path which is substantially parallel to and co-planar with the inner face of the door when in the closed position. The arm in this case is preferably of an L cross-section, with the upright limb 81 of the L providing the stop member and the horizontal limb 82 of the L providing the arm carrying the stop member. The upright 81 is set back some distance from the face of the door when closed, as shown in FIG. 14, to enable the door to be partially opened before it butts against upright 81. The upright 81 can carry a wedge shaped member 83, e.g. of wood or rubber, so that the interior face of the door seats truly against the upright limb. The horizontal limb 82 of the L is trapped under the door when the door butts against the upright 81 and thus secures the stop against release until the door is closed sufficiently to release the limb 80 which can then be swung upwardly and out of the path of the door about pivot 80.

The above forms of door stop are characterised in that the stop member has to pass through a point on its travel from its operative to its inoperative positions where it passes in close proximity to the interior face of the closed door. It will be appreciated that the benefits of the present invention can be achieved even where the door does not have to be totally closed and latched shut in order to permit the passage of the stop member. Thus, the invention applies to doors which have entered the door frame so that an intruder can not then insert an instrument to gain access to the stop mechanism behind the door. Preferably, the door has to be closed to within 0.1 to 20 mms of its full travel before the stop member can be released.

It is also preferred that the path of the stop member follow a line of travel by which it most closely approaches the interior face of the closed door before it travels clear of the leading edge of the door. In this way, it is possible to provide the assembly with means for interrupting the travel of the stop at an intermediate position in which the stop will retain the door in the fully closed position until the stop is released as described above.

The door stop mechanisms of the invention can be made from a wide range of suitable materials, e.g. metals such as brass, steel or aluminium, wood or plastics, and of an suitable dimensions having regard to the size of the door they are to fit. Typically, the components of the mechanisms can be made by suitable moulding, machining, forging and/or pressing techniques.

The invention has been described above in terms of a door stop to limit the opening swing of the door. However, the invention can be applied as a door catch which is to work at the open end of the arc of swing of the door and acts to hold the door open. The term 'closed' as herein is therefore to be construed as denoting either extremity of the travel of the door.

The stop mechanism is typically operated by knocking the stop member into the path of the door before the door catch is released. As indicated above, the stop can be spring biassed into the operative position, for example the arm 25 of the device shown in FIG. 4 can be biassed by a torsion spring, and held in its in-operative position by a stud or other catch until required. Such a mechanism is of especial benefit to enable the elderly or infirm to operate the stop mechanism rapidly and simply. If desired, the mechanism can be provided with means for remote control thereof, notably to provide means for releasing the mechanism from a central control point in the event of a fire or other emergency.

I claim:

1. A closure means, comprising:

a support frame having an opening;

a closure member having a bottom edge, a first side and a second side opposite said first side, pivotally mounted at said first side in said opening to a first edge of said frame for pivotal movement between an open position and a closed position, said second side having a leading edge which traces a horizontal arc of swing of said closure member when said closure member pivots between said open and closed positions, said leading edge closely opposing a second edge of said opening opposite said first edge when said closure member is in said closed position, said closure member having a face between said first side and said second side facing said arc of swing when said closure member is in said closed position; and a closure member restriction mechanism located adjacent said frame and said horizontal arc of swing, said mechanism including a generally vertically extending stop member, and guide means, below said bottom edge, for guiding said stop member in a generally horizontal travel path across said arc of swing, between an operative position radially inside the arc of swing, and an inoperative position outside said arc of swing via an intermediate position on said arc of swing adjacent said second edge of said frame; limit means provided on said guide means for limiting horizontal movement of said stop member to said travel path between said operative position and said inoperative position, said stop member projecting upwardly from said guide means above said bottom edge so as to block said closure member from movement past said stop member in a direction away from said closed position toward said open position when said stop member is in said intermediate position, said travel path passing sufficiently close to said face when said closure member is in its closed position that when said stop member is at said operative position and said closure member is between said closed position and said stop member, movement of said stop member along said travel path to said inoperative position moves said stop member into contact with said face of said closure member and pushes said leading edge of said closure member at least partially into said opening.

2. A mechanism as in claim 1, wherein said guide means comprises a guide member rotatable about a vertical axis, said stop member being mounted on said guide member at a location radially spaced from said vertical axis.

3. A mechanism as in claim 1, wherein said guide means comprises a track member having a track extending along said travel path, said stop member engaging said track so as to be movable therealong.

4. A mechanism as in claim 1, wherein said guide means comprises a track member having an elongated aperture therein defining said travel path, the extremities of said aperture defining said operative position and said inoperative position of said stop member.

5. A mechanism as in claim 4, wherein said track member receives said stop member therein and guides said stop member between two extremities of travel.

6. A mechanism as in claim 1, wherein said travel path has an arcuate shape.

7. A mechanism as in claim 2, wherein said guide means includes a base member and said guide member includes a first horizontal member having said stop member mounted thereon, rotatable about a vertical axis and mounted on said base member, said base member having limit members provided thereon so as to limit an arc of travel of said first horizontal member.

8. A mechanism as in claim 7, wherein said limit members comprise a second horizontal member having an elongated aperture formed defining said travel path, the extent of said travel path being limited by the extremities of said aperture, said stop member engaging said aperture.

9. A mechanism as in claim 8, wherein said stop member protrudes from said aperture, said aperture being arcuate, said extremities of said aperture forming said limit means.

10. A closure device as in claim 1, wherein said intermediate position is sufficiently close to said second edge of said frame that when said stop member is between said operative position and said intermediate position and said closure member is between said closed position and said stop member, movement of said stop member past said intermediate position to said inoperative position pushes said leading edge at least partially into said opening.

* * * * *